US011586136B2

(12) United States Patent
Eguchi et al.

(10) Patent No.: US 11,586,136 B2
(45) Date of Patent: Feb. 21, 2023

(54) IMAGE FORMING APPARATUS THAT CHANGES A THROUGHPUT BASED ON A VALUE RELATED TO A NUMBER OF SHEETS ON WHICH IMAGES HAVE BEEN FORMED

(71) Applicant: Canon Kabushiki Kaisha, Tokyo (JP)

(72) Inventors: Hiroki Eguchi, Kanagawa (JP); Munehito Kurata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/157,014

(22) Filed: Jan. 25, 2021

(65) Prior Publication Data

US 2021/0232076 A1 Jul. 29, 2021

(30) Foreign Application Priority Data

Jan. 28, 2020 (JP) ..... JP2020-011449

(51) Int. Cl.
*G03G 15/00* (2006.01)
*G03G 15/20* (2006.01)

(52) U.S. Cl.
CPC ..... *G03G 15/505* (2013.01); *G03G 15/2039* (2013.01); *G03G 15/2046* (2013.01); *G03G 2215/2045* (2013.01)

(58) Field of Classification Search
CPC ..... G03G 15/2046; G03G 2215/2045
See application file for complete search history.

(56) References Cited

U.S. PATENT DOCUMENTS

2016/0139550 A1* 5/2016 Ishida ..... B65H 5/062 399/45
2016/0154357 A1* 6/2016 Naruse ..... H04N 1/00986 358/1.5
2017/0038710 A1* 2/2017 Tamura ..... G03G 15/2046
2017/0219980 A1* 8/2017 Sato ..... G03G 15/5062
2019/0025744 A1* 1/2019 Hirose ..... G03G 15/6594

FOREIGN PATENT DOCUMENTS

JP 2000250374 A 9/2000
JP 2001265161 A 9/2001
JP 2003050519 A 2/2003
JP 2003076171 A 3/2003
JP 2003091212 A 3/2003
JP 2006301110 A 11/2006

OTHER PUBLICATIONS

English machine-translation of JP2003-091212 (Year: 2003).*

* cited by examiner

*Primary Examiner* — Arlene Heredia
(74) *Attorney, Agent, or Firm* — Venable LLP

(57) ABSTRACT

An image forming apparatus includes a control unit configured to, in executing a job to form images continuously on a plurality of sheets of a recording material, accumulate an addition amount per sheet to an index in accordance with a number of sheets of the recording material to which images are formed in the job. A value of the addition amount per sheet is determined in correspondence with an attribute of the recording material used in the job. The control unit is configured to, during execution of the job, change a throughput of the job so that images are formed at a first throughput if an accumulated value of the index still does not exceed a predetermined threshold value and images are formed at a second throughput slower than the first throughput if the accumulated value of the index has exceeded the threshold value.

4 Claims, 9 Drawing Sheets

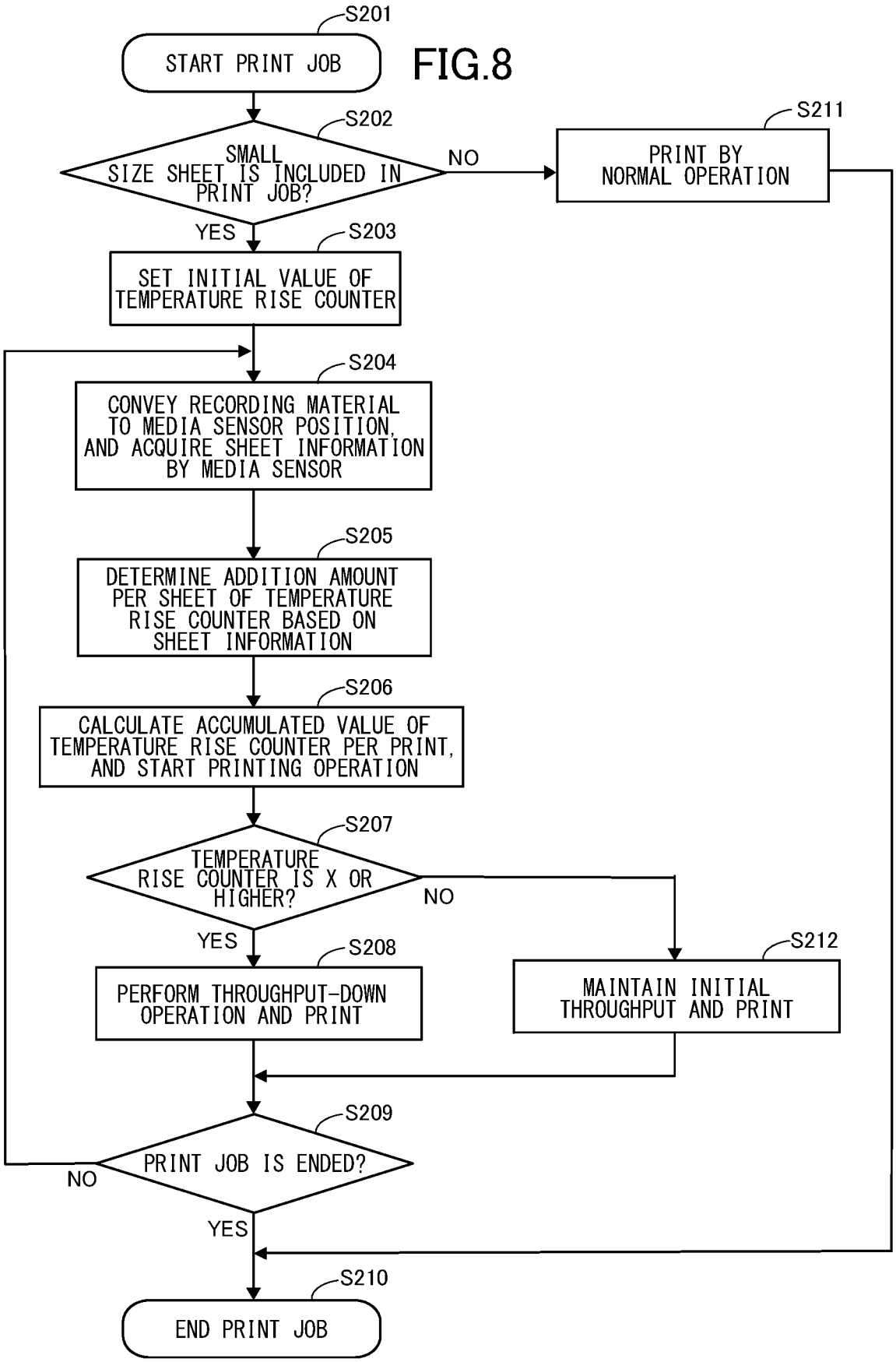
FIG.8
S201
START PRINT JOB
S202
SMALL SIZE SHEET IS INCLUDED IN PRINT JOB?
NO
YES
S211
PRINT BY NORMAL OPERATION
S203
SET INITIAL VALUE OF TEMPERATURE RISE COUNTER
S204
CONVEY RECORDING MATERIAL TO MEDIA SENSOR POSITION, AND ACQUIRE SHEET INFORMATION BY MEDIA SENSOR
S205
DETERMINE ADDITION AMOUNT PER SHEET OF TEMPERATURE RISE COUNTER BASED ON SHEET INFORMATION
S206
CALCULATE ACCUMULATED VALUE OF TEMPERATURE RISE COUNTER PER PRINT, AND START PRINTING OPERATION
S207
TEMPERATURE RISE COUNTER IS X OR HIGHER?
NO
YES
S208
PERFORM THROUGHPUT-DOWN OPERATION AND PRINT
S212
MAINTAIN INITIAL THROUGHPUT AND PRINT
S209
PRINT JOB IS ENDED?
NO
YES
S210
END PRINT JOB

IMAGE FORMING APPARATUS THAT CHANGES A THROUGHPUT BASED ON A VALUE RELATED TO A NUMBER OF SHEETS ON WHICH IMAGES HAVE BEEN FORMED

BACKGROUND OF THE INVENTION

Field of the Invention

The present invention relates to an image forming apparatus for forming an image on a sheet of recording material.

Description of the Related Art

Image forming apparatuses that adopts an electrophotographic system used as a printer, a copying machine, a multifunctional machine and so on are equipped with a fixing unit for fixing an image on a sheet of recording material by heating a toner image transferred to the sheet. The fixing unit heats the toner image on the sheet while nipping and conveying the sheet by a fixing nip formed between a heating member taking a form of a roller or a film and a pressure roller opposed to the heating member.

The fixing unit carries out a fixing process to sheets of recording materials having various shapes and sizes, so that a portion of the fixing nip may remain as an area through which sheets of some types of recording materials do not pass, i.e., a non-sheet passing portion, and during execution of an image forming job, the temperature of the non-sheet passing portion may rise gradually. If excessive rising of temperature of the non-sheet passing portion occurs due to this phenomenon, i.e., temperature rise of non-sheet passing portion, there is fear that damage may occur to components constituting the fixing unit. Further, if a preceding job using a small-size sheet is immediately followed by a succeeding job using a large-size sheet, a so-called hot offset may occur in the succeeding job at a portion which had been the non-sheet passing portion during the preceding job.

Japanese Patent Application Laid-Open Publication No. 2000-250374 discloses detecting temperature rise of a non-sheet passing portion using a thermistor provided on the non-sheet passing portion of a fixing device, and if the temperature of the non-sheet passing portion reaches a predetermined temperature, conveyance of the sheets is temporarily discontinued, and conveyance is restarted after reducing a throughput, i.e., number of sheets to which images are output per unit time. Japanese Patent Application Laid-Open Publication No. 2003-076171 discloses suppressing temperature rise of the non-sheet passing portion by setting the throughput to a normal value if paper size is unknown when starting printing operation, and switching the throughput to low speed if it is determined after starting the printing operation that the paper size is a small size. Japanese Patent Application Laid-Open Publication No. 2003-050519 discloses suppressing the temperature rise of non-sheet passing portion by reducing throughput while performing continuous sheet passing operation of envelopes.

According to the configuration of Japanese Patent Application Laid-Open Publication No. 2000-250374, a thermistor is provided to detect the temperature rise of non-sheet passing portion independently from a thermistor for temperature control provided on the sheet passing portion, so that the fixing unit may be increased in size or become complicated. Meanwhile, according to the configuration of Japanese Patent Application Laid-Open Publication No. 2003-076171, the throughput will be switched to low speed at the point of time when the paper size is determined to be a small size. Therefore, even in a case where the temperature rise of the non-sheet passing portion will still fall within a permissible range by maintaining the throughput to normal since the number of output of the image is small, the throughput will still be set to low speed so that a waiting time before the user obtains a product was extended.

Further, if the throughput is reduced during the continuous sheet passing operation, as according to Japanese Patent Application Laid-Open Publication No. 2003-050519, the exact timing at which the temperature rise of the non-sheet passing portion exceeds the permissible range differs according to size and material of the recording material. Therefore, depending on the property of the recording material, the low speed throughput may be applied even when the temperature rise of the non-sheet passing portion still remains within a permissible range, and the waiting time of the user was extended.

SUMMARY OF THE INVENTION

The present invention provides an image forming apparatus that can shorten a waiting time of user with a simple configuration.

According to one aspect of the invention, an image forming apparatus includes an image forming unit configured to form an image on a sheet of a recording material, a fixing unit configured to fix the image formed by the image forming unit to the sheet and including a heating member configured to contact the sheet to heat the image on the sheet, and a control unit configured to control the image forming unit and the fixing unit. The control unit is configured to, in executing a job to form images continuously on a plurality of sheets of a recording material by the image forming unit and the fixing unit, accumulate an addition amount per sheet to an index regarding a temperature of the heating member in accordance with a number of sheets of the recording material to which images are formed in the job. A value of the addition amount per sheet to be accumulated to the index is one of values predetermined in correspondence with attributes of recording materials, and is determined in correspondence with an attribute of the recording material used in the job. The control unit is configured to, during execution of the job, change a throughput of the job so that images are formed at a first throughput if an accumulated value of the index still does not exceed a predetermined threshold value and images are formed at a second throughput slower than the first throughput if the accumulated value of the index has exceeded the threshold value.

According to another aspect of the invention, an image forming apparatus includes an image forming unit configured to form an image on a sheet of a recording material, a fixing unit configured to fix the image formed by the image forming unit to the sheet and including a heating member configured to contact the sheet to heat the image on the sheet, and a control unit configured to control the image forming unit and the fixing unit. The control unit is configured to execute a job to form images continuously on a plurality of sheets of a recording material by the image forming unit and the fixing unit, such that images are formed at a first throughput before an accumulated number of output sheets on which images have been formed since starting of the job exceeds a threshold number, and images are formed at a second throughput slower than the first throughput after the accumulated number of output sheets has exceeded the threshold number. The control unit is configured such that a value of the threshold number is changed in accordance with an attribute of the recording material used in the job.

Further features of the present invention will become apparent from the following description of exemplary embodiments with reference to the attached drawings.

BRIEF DESCRIPTION OF THE DRAWINGS

FIG. 8 is a flowchart illustrating a method of throughput-down control according to the second embodiment.

DESCRIPTION OF THE EMBODIMENTS

Figure 1:
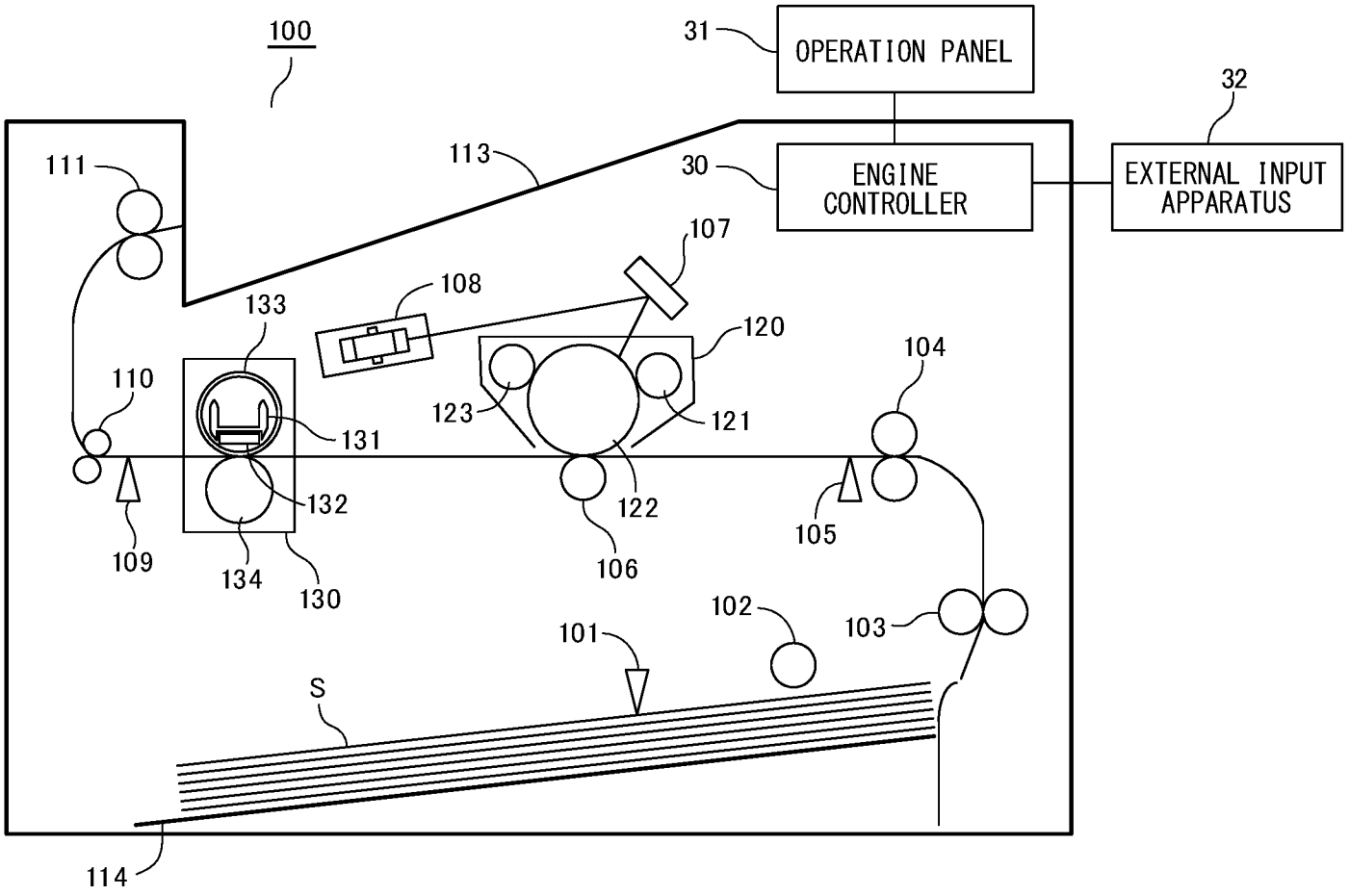
FIG. 1 is a schematic drawing of an image forming apparatus according to a first embodiment.

Now, exemplary embodiments of the present disclosure will be described while referring to the drawings.

First Embodiment (1) Image Forming Apparatus

FIG. 1 is a cross-sectional view illustrating a general configuration of an image forming apparatus 100 according to a first embodiment. A general configuration of the image forming apparatus 100 and a printing operation for recording an image on a sheet of recording material, i.e., image forming operation, will be described with reference to FIG. 1.

As illustrated in FIG. 1, the image forming apparatus 100 according to the present embodiment is equipped with a cartridge 120 that is detachably attached to an image forming apparatus body. The cartridge 120 is provided with a developing roller 121, a photosensitive drum 122 and a charge roller 123. The cartridge 120 is an example of an image forming unit for forming a toner image on a sheet of recording material via an electrophotographic process.

When a printing operation is started, at first, the photosensitive drum 122 serving as an image bearing member, i.e., electrophotographic photoconductor, is driven to rotate, and the surface of the photosensitive drum 122 is charged uniformly to predetermined potential by the charge roller 123. Laser light emitted from a laser optical box 108 and reflected on a laser light reflecting mirror 107 is projected to the charged surface of the photosensitive drum 122. The laser light is modulated, i.e., subjected to on/off conversion, in response to signals that have been converted from the image information to be printed entered via an image signal generating apparatus such as an image reading apparatus or a computer (not shown) to time-series electric digital pixel signals, i.e., so-called video signals Scan exposure is performed by projecting the laser light, and a latent image corresponding to the image information, i.e., electrostatic latent image, is formed on the photosensitive drum surface. In this process, the timing for starting scan exposure in a sub-scanning direction is notified to an image signal generator from an image forming apparatus via a sub-scanning-direction synchronization signal. The latent image formed in correspondence to the target image is developed by the developing roller 121 and becomes a toner image.

Next, in a state where presence of a sheet of recording material in the sheet feeding cassette 114 is detected by a sheet presence/absence sensor 101, one sheet S is fed from the sheet feeding cassette 114 by a feed roller 102 and conveyed via a conveyance roller 103 and a registration roller 104. In this state, a leading edge of the sheet S is detected by a top sensor 105, and the sheet S is conveyed to a nip portion, i.e., transfer nip, between the photosensitive drum 122 and a transfer roller 106 in synchronization with the toner image formed on the photosensitive drum 122. The feed roller 102 is merely an example of a feeding portion by which the sheet S is fed one sheet at a time, and for example, a mechanism can be adopted where the sheet S is sucked onto a permeable belt using vacuum for sucking air to feed the sheet S.

The transfer roller 106 supplies charge having opposite polarity as the normal charge polarity of toner from the rear side of the sheet S, so that it functions as a transfer portion for transferring the toner image from the photosensitive drum 122 to the sheet S. The sheet S having received transfer of toner image from the transfer roller 106 is separated from the photosensitive drum 122 and sent to a fixing unit 130 serving as an image heating apparatus, where the sheet S is nipped and conveyed by the nip portion to be heated and pressed, and the unfixed toner image is fixed to the sheet S. Passing of the leading edge of the sheet S having been subjected to the fixing process is detected by a sheet discharge sensor 109, and the sheet is conveyed by a post-fixing roller 110 and a sheet discharge roller 111 to be discharged onto a sheet discharge tray 113. Thus, a sequence of the printing operation, i.e., sheet passing operation, of one sheet of recording material is completed.

If printing operation for forming images continuously to a plurality sheets S of recording material, i.e., continuous sheet passing operation, is executed, the sheets S are fed one sheet at a time from the sheet feeding cassette 114. In the cartridge 120, after preparation toner image to be transferred to a preceding sheet S is completed, preparation of toner image to be transferred to a succeeding sheet S is started at a predetermined interval from the former image. Further, the registration roller 104 sends the succeeding sheet S toward the transfer nip after a predetermined interval corresponding to the aforementioned predetermined interval. Thereby, the image forming apparatus 100 forms images continuously while conveying sheets at predetermined intervals and discharges the sheets to the sheet discharge tray 113.

The image forming apparatus 100 includes an engine controller 30 that performs overall control of the image forming apparatus. The engine controller 30 serving as a control unit according to the present embodiment is a control circuit including at least one processor and a storage portion. One example of the storage portion is a nonvolatile memory such as an EEPROM that stores image forming conditions and attribute information of the recording material (hereinafter referred to as "sheet information"), values of a temperature rise counter described later, and so on. The processor reads a program stored in the storage portion and controls the operation of the image forming apparatus 100 including the printing operation based on the sheet information and temperature rise counter information. Further, as described later, the engine controller 30 according to the present embodiment can change throughput of the printing operation by controlling at least either one of the interval between sheets and a conveyance speed when executing the continuous sheet passing operation.

The engine controller 30 is connected to an operation panel 31 for entering various settings to the image forming apparatus 100, and an external input apparatus 32 such as a PC. The engine controller 30 starts a print job which is a task of a printing operation based on user operation on the operation panel 31 or reception of an execution command of a print job, i.e., print command, from the external input apparatus 32. The print job is composed of information indicating image data to be printed, i.e., image information, and information denoting sheet information of the recording material to be used or information designating the number of prints to be output, i.e., job information.

The types of recording materials that can be distinguished by the image forming apparatus 100 based on attribute information such as size and material, i.e., grammage and presence/absence of surface treatment, and manufacturer are referred to as "sheet type". Various types of sheets having different sizes and materials, such as paper including plain paper and thick paper, plastic films, cloth, coated paper and other sheet materials to which surface treatment has been performed, sheet materials having special shapes such as envelopes and index sheets, can be used as a sheet S of recording material.

As for the specification of the image forming apparatus used in the present embodiment, a processing speed of the apparatus is 240 mm/sec. Further, a maximum sheet width is 297 mm, which corresponds to long edge feeding of an A3-size sheet, where a sheet width is a length of a sheet of recording material in a direction orthogonal to a sheet conveyance direction (i.e., conveyance direction of the sheet).

(2) Fixing Unit

Figure 2:
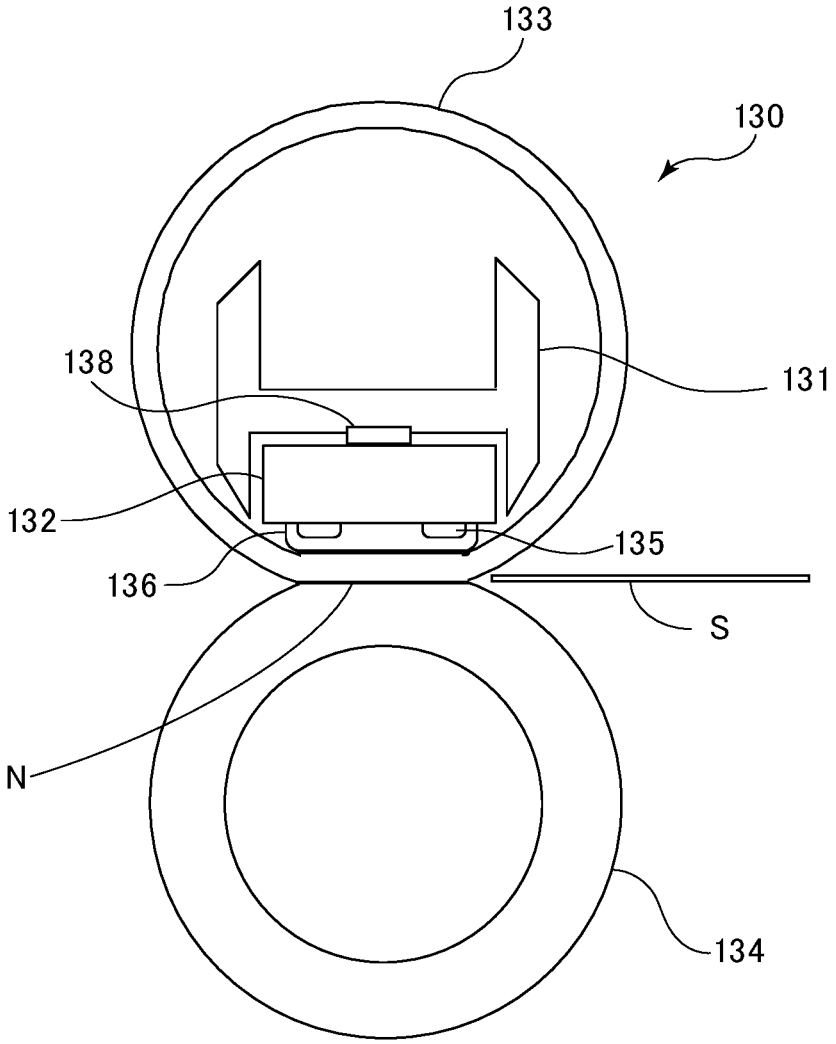
FIG. 2 is a schematic drawing of a fixing unit according to the first embodiment.

Next, the fixing unit 130 according to the present embodiment will be described. FIG. 2 is a cross-sectional view illustrating a general configuration diagram of the fixing unit 130 adopting a film heating system according to the present embodiment.

The fixing unit 130 includes a heater 132 serving as a heating unit, a guide member 131 serving as a holding member for holding the heater 132, a heat resistant film (hereinafter referred to as film) 133, and a pressure roller 134 serving as a pressing member. The film 133 is a member having an endless shape or tubular shape that is externally fit to the guide member 131. A nip portion N, i.e., fixing nip, is formed between the film 133 and the pressure roller 134 at a position where the heater 132 and the film 133 oppose to each other. The film 133 and the pressure roller 134 correspond to a pair of rotary members that are in pressure contact with each other to form a nip portion N. The heater 132 corresponds to a sliding member that is arranged on an inner circumference side of the film 133 and comes to sliding contact with the film 133.

Hereafter, an axial direction of the pressure roller 134, that is, a generatrix direction of the film 133 or direction orthogonal to a sheet conveyance direction, is referred to as a longitudinal direction of the fixing unit 130.

(2-1) Guide Member 131

The guide member 131 is a member formed of heat-resistant resin that supports the heater 132 and also serves as a conveyance guide of the film 133. The guide member 131 may be formed of highly heat-resistant resin having superior workability such as polyimide, polyamide-imide, polyether ether ketone (PEEK), polyphenylene sulfide and liquid crystal polymer, or a composite material composed of these resins and ceramic, metal or glass. A liquid crystal polymer was used in the present embodiment.

(2-2) Heater 132

A ceramic heater is used as the heater 132. A ceramic substrate having a good heat conductivity and insulation property formed of ceramics such as alumina and aluminum nitride is used as the heater substrate. An appropriate thickness of the ceramic substrate (hereinafter referred to as substrate) is approximately 0.5 to 1.0 mm in order to reduce thermal capacity, and it is formed in a rectangular shape having a width of approximately 10 mm and a length of approximately 300 mm.

A resistance heating element 135 is formed on one surface, i.e., front surface, of the heater 132 along the longitudinal direction. A main component of the resistance heating element 135 may be silver-palladium alloy, nickel tin alloy, ruthenium oxide alloy or the like, which is formed by screen printing and the like to a thickness of approximately 10 μm and a width of approximately 1 to 5 mm.

An insulation glass 136 serving as an insulating layer is coated on a front side of the heater substrate and the resistance heating element 135. In addition to ensuring an insulation property between the resistance heating element 135 and an external conductive member, such as a conductive layer of the film 133, the insulation glass 136 serves to prevent mechanical damages. The appropriate thickness of the insulation glass 136 is approximately 20 to 100 μm. The insulation glass 136 also serves as a slide layer that comes to sliding contact with the film 133.

(2-3) Heat Resistant Film 133

The film 133 is externally fit to the guide member 131 supporting the heater 132. The film 133 is configured such that an inner circumferential length will be greater than an outer circumferential length of the guide member 131 supporting the heater 132. Thus, the film 133 is externally fit to the guide member 131 with a margin in the circumferential length.

A single-layer film such as PTFE, PFA and FEP having a film thickness of 20 to 70 μM and heat resistance or a composite layer film can be used as the film 133 to efficiently apply the heat of the heater 132 at the nip portion N to the sheet of recording material serving as a heated material. A composite layer film including polyimide, polyamide-imide, PEEK, PES, PPS or SUS (stainless steel) as a base layer is used as the composite layer film. The composite layer film is formed by coating, on an outer circumference of the base layer, an elastic layer formed of a material in which a thermally conductive filler such as ZnO, $Al_2O_3$, SiC and metallic silicon is mixed to an elastic material such as silicon rubber with the aim to enhance fixing property, and further coating PTFE, PFA, FEP and the like on the outermost surface thereof. In the present embodiment, polyimide with a film thickness of 50 μm was used as the base layer, and the surface thereof was coated with PFA. In the present description, PTFE represents polytetrafluoroethylene, and PFA represents a copolymer of tetrafluoroethylene and perfluoro-alkyl vinyl ether. FEP represents a copolymer of tetrafluoroethylene and hexafluoropropylene, PES represents polyethersulfone, and PPS represents polyphenylene sulfide.

(2-4) Pressure Roller 134

The pressure roller 134 is a member that forms a nip portion N with the heater 132 interposing the film 133 and that drives the film 133 to rotate. The pressure roller 134 is an elastic roller including an elastic layer formed of heat-resistant rubber such as silicon rubber or fluororubber or by foaming silicon rubber arranged on an outer circumference of a metal core formed of SUS, SUM, Al and the like. The pressure roller 134 may have a releasing layer formed of PFA, PTFE, FEP and the like disposed on the elastic layer. The present embodiment adopted an aluminum core metal, a silicon rubber having a thickness of 4.0 mm as the elastic layer and PFA having a thickness of 50 μm as the releasing layer.

(2-5) Thermistor 138

A thermistor 138 is an element for detecting temperature, i.e., temperature detecting element, of the heater 132 at a center portion in the longitudinal direction thereof. The temperature detected by the thermistor 138 is entered to the engine controller 30. The thermistor 138 is an NTC (Negative Temperature Coefficient) thermistor whose resistance drops as the temperature rises. The temperature of the heater 132 is monitored by the engine controller 30 by referring to an output signal, such as a voltage, of the thermistor 138 in accordance with the temperature of the heater 132. The engine controller 30 adjusts the power supplied to the heater 132 by comparing the temperature detected by the thermistor 138 and a predetermined target temperature. Thereby, heating amount of the heater 132 is controlled such that the heater 132 maintains the target temperature.

Figure 3:
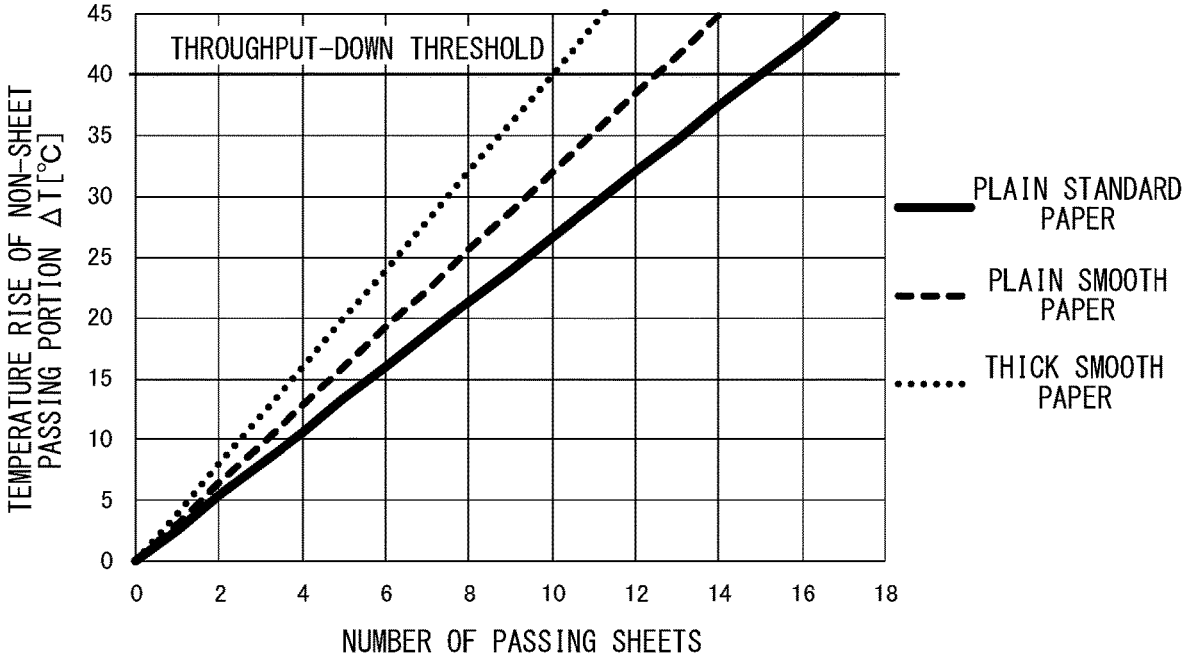
FIG. 3 illustrates a measurement result of a temperature rise of non-sheet passing portion for each sheet type according to the first embodiment.

(3) Speed Difference of Temperature Rise of Non-Sheet Passing Portion According to Sheet Type FIG. 3 illustrates a surface temperature difference between a sheet passing portion and a non-sheet passing portion of the film 133, hereinafter referred to as temperature rise of non-sheet passing portion, in a case where an A4-size sheet is subjected to continuous sheet passing operation by long edge feeding using the fixing unit 130. In the present measurement, the sheet passing operation was performed in a state where a thermistor for measuring temperature of the non-sheet passing portion was used in addition to the thermistor 138 arranged at the center portion in the longitudinal direction. The sheet passing portion refers to an area of the fixing unit 130 in a longitudinal direction which is an area where the film 133 contacts the sheet when a sheet having a target size passes a predetermined position, such as a position where a center of the sheet in the width direction corresponds to a center of the fixing nip in the longitudinal direction. The non-sheet passing portion refers to an area of the fixing unit 130 in the longitudinal direction, which is an area where the film 133 does not contact the sheet when the sheet having the target size passes the predetermined position, that is, an area outside the sheet passing portion in the longitudinal direction.

It is assumed that 10 seconds or more have elapsed from the previous printing at the fixing unit 130, and that a detection temperature of the thermistor 138 immediately after starting the printing operation is lower than 50° C., that is, in a cold state. Three types of paper having different thicknesses and surface properties, which are plain standard paper, plain smooth paper and thick smooth paper, were used as the recording materials. Canon Red Label Presentation having a grammage of 80.0 g/m$^2$, which is a product of Canon Inc., was used as the plain standard paper. GF-0081 having a grammage of 81.4 g/m$^2$, which is a product of Canon Inc., was used as the plain smooth paper. NPI high-quality paper having a grammages of 127.9 g/m$^2$, which is a product of Nippon Paper Industries Co., Ltd., was used as the thick smooth paper.

Based on FIG. 3, it can be seen that inclination of temperature rise of non-sheet passing portion with respect to the number of passing sheets is greatest in thick smooth paper, followed by plain smooth paper and plain standard paper. That is, temperature rise of non-sheet passing portion tends to advance faster when using a recording material having a greater grammage. Further, temperature rise of non-sheet passing portion tends to advance faster when using a recording material having a smoother surface property. This is because the amount of power supply to the heater 132 that is necessary to maintain a target temperature differs due to grammage and surface property of the recording material subjected to sheet passing when the target temperature of the thermistor 138 is the same. Since a recording material having a greater grammage has a greater thermal capacity, the amount of power supply to the heater 132 increases in order to maintain the target temperature of the thermistor 138. As for a recording material having a smooth surface property, adhesion between the film 133 and a sheet of the recording material surface becomes high, so that thermal conductivity between the film 133 and the sheet of the recording material is higher compared to plain paper. Since heat quantity transmitted to the sheet of the recording material from the heater 132 through the film 133 becomes greater, the amount of power supply to the heater 132 is increased to maintain the target temperature of the thermistor 138. If the amount of power supply to the heater 132 is increased, the temperature of the film 133 and the pressure roller 134 rises faster in the non-sheet passing portion that does not contact the sheet of the recording material compared to a case where the amount of power supply is small.

In order to avoid excessive temperature rise of non-sheet passing portion and maintain the effect of the temperature rise of non-sheet passing portion to fall within the permissible range, the fixing unit 130 according to the present embodiment is set to perform throughput-down operation in a case where the temperature rise of non-sheet passing portion reaches 40° C. or higher. An allowable number of passing sheets before the temperature rise of non-sheet passing portion reaches 40° C. is 15 sheets for plain standard paper, 13 sheets for plain smooth paper and 10 sheets for thick smooth paper, as can be recognized based on the measurement results illustrated in FIG. 3.

That is, a high throughput that can be realized by the image forming apparatus, i.e., initial throughput or first throughput according to the present embodiment, is applied when starting the printing operation, while a relatively low throughput, i.e., second throughput according to the present embodiment, is applied after the number of sheets has exceeded the threshold number of sheets. Such throughput-down control (control for performing the throughput-down operation) widens the interval between successive sheets, that is, interval between sheets, so that the temperature difference between the non-sheet passing portion and the sheet passing portion reduces, i.e., heat is uniformized, during the interval between sheets, and excessive temperature rise of non-sheet passing portion can be suppressed.

Now, a case where control is performed using the image forming apparatus 100 without discriminating the types of the recording materials is set as a reference example. In a case where a sheet of a recording material having an A4 size is passed by long edge feeding in the reference example, the number of passing sheets before throughput-down control is performed, i.e., allowable number of passing sheets for initial throughput, or threshold number of sheets, should be set to 10 sheets for thick smooth paper as illustrated in FIG. 3, for example. If the allowable number of passing sheets for initial throughput is set to a value exceeding 10 sheets, the temperature rise of non-sheet passing portion may exceed 40° C. in a case where thick smooth paper is passed. However, if plain standard paper or plain smooth paper is passed, the temperature rise of non-sheet passing portion does not actually reach 40° C. at a point of time when 10 sheets have passed, so that the allowable number of passing sheets for initial throughput can actually be set to a number that is greater than 10 sheets. Therefore, according to the present embodiment, the allowable number of passing sheets before performing throughput-down control is optimized based on grammage information and surface property information of the recording material subjected to the sheet passing.

(4) Throughput-Down Control Method

According to the present embodiment, whether to perform throughput-down control is determined using an indicator or index that indicates advancement of temperature rise of non-sheet passing portion referred to as a temperature rise counter. The temperature rise counter is a variable storing an accumulated value in which a numerical value, i.e., addition amount per sheet is added per one sheet of the recording material subjected to printing. The values of the addition amount per sheet differ in accordance with attributes (grammage information and surface property information) of the recording materials. The engine controller 30 is designed to perform throughput-down control in a case where the value of the temperature rise counter exceeds a predetermined threshold value. In the following description, calculation and comparison using the temperature rise counter is performed in the engine controller 30.

(4-1) Flowchart of Throughput-Down Control

Figure 4:
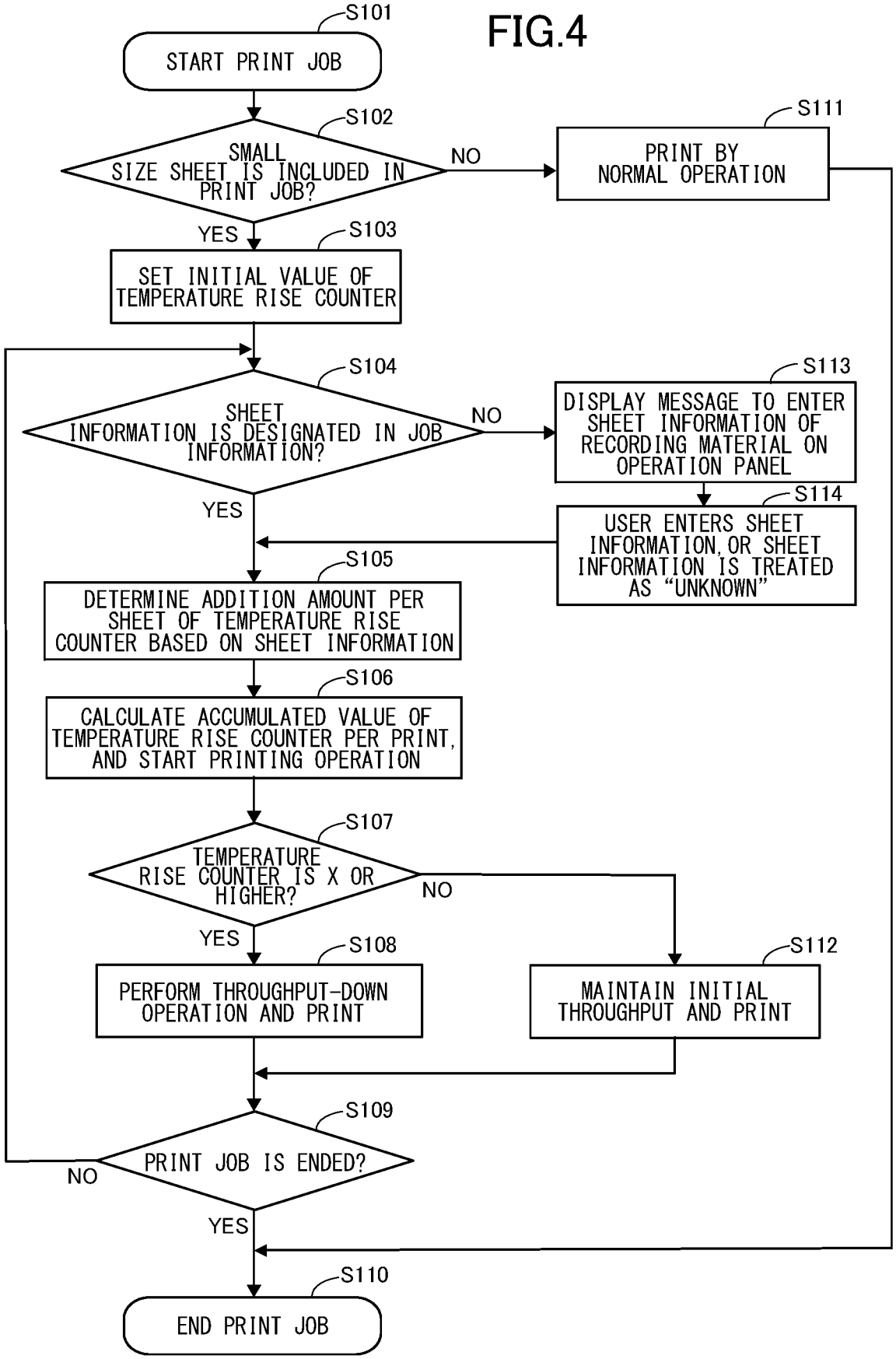
FIG. 4 is a flowchart illustrating a method for controlling throughput-down operation according to the first embodiment.

The present embodiment illustrates a case where the user enters a sheet information of a recording material. FIG. 4 is a flowchart of throughput-down control according to the first embodiment. At first, in S101, a print job is transmitted from the external input apparatus 32 to the engine controller 30.

In S102, it is determined in the engine controller 30 whether small-size sheet is included in the print job based on sheet size information in the print job. Information set in advance by the user through the operation panel 31 (FIG. 1), i.e., user-designated information, can be used as the sheet size information. That is, the operation panel 31 is an example of an input unit through which the user can enter information related to the attribute of the recording material to be used in the print job. Further, a result by a sheet size detection mechanism provided in the sheet feeding cassette 114 or a detection result by a sheet width sensor (not shown) provided on a sheet conveyance path in the image forming apparatus 100 can be used either instead of the user-designated information or in addition to the user-designated information as the sheet size information. If a sheet width sensor is used, the procedure advances from S101 to S102 at a timing when the sheet has been conveyed to a sheet width sensor position.

"Small-size sheet" refers to a sheet of a recording material having a sheet width, i.e., length of the sheet in a direction orthogonal to the sheet conveyance direction, smaller than a predetermined length, and "large-size sheet" refers to a sheet of a recording material having a sheet width greater than the predetermined length. "Predetermined length" is determined in advance based on whether a temperature rise of non-sheet passing portion occurs that may actualize influences such as the damaging of the fixing unit or hot offset, and in the present embodiment, for example, A3-size sheet by long edge feeding is classified as the large-size sheet, and A4-size sheet by long edge feeding or smaller is classified as the small-size sheet.

If small-size sheet is not included in the print job, the procedure advances to S111, and printing is performed by normal operation where throughput-down control is not performed, before advancing to end print in S110. If small-size sheet is included in the print job, the procedure advances to S103. In S103, an initial value of a temperature rise counter is set according to Table 3 described later, and the procedure advances to S104.

In S104, whether sheet information is included in a job information of the print job is determined. In the case of the present embodiment, the sheet information includes at least either information related to grammage or information related to surface property of the recording material being used, such as designation of sheet brand, entry of actual numerical value of grammage, and information for selecting whether the sheet is a thick paper or a smooth paper based on sheet classifications registered in advance. If a feed source whose sheet information is set in advance is selected by the user, or if a sheet information is designated via the external input apparatus 32, it is determined that sheet information is designated, and the procedure advances to S105. Meanwhile, if there is no sheet information, the procedure advances to S113, and a message notifying the user to enter sheet information of the feed source being used is displayed on the operation panel 31. Thereafter, in S114, the user enters whether the recording material being used corresponds to thick paper or to smooth paper. If the user skips entry of the sheet information or if entry is not performed for a predetermined time, the sheet information is treated as "unknown". Thereafter, the procedure advances to S105. Based on the procedure described above, the sheet information of the recording material used for the current job is determined.

In S105, the sheet information of the current job is applied to a temperature rise counter setting table of Table 1 and Table 2 described later, and a value of the addition amount per sheet of the temperature rise counter to be applied for each sheet passing is determined. Then, in S106, the accumulated value of the temperature rise counter is calculated for each sheet passing, and printing operation by the image forming apparatus 100 is started. The accumulated value of the temperature rise counter is not set to a negative value, and if the value becomes negative, the value is converted to 0. Next, in S107, whether the accumulated value of the temperature rise counter at a current point of time has reached a throughput-down threshold, that is, threshold value of index according to the present embodiment, is compared.

In the present embodiment, the throughput-down threshold is predetermined as "15". A case where the accumulated value of the temperature rise counter is 15 corresponds to a number of passing sheets in a case where the temperature rise of non-sheet passing portion is 40° C. according to the measurement result of FIG. 3. If the accumulated value of the temperature rise counter is less than 15, the procedure advances to S112, where printing operation is performed while maintaining the initial throughput, and the procedure advances to S109. Meanwhile, if the accumulated value of the temperature rise counter is 15 or greater, the procedure advances to S108, where throughput-down operation is performed, and printing is executed. Thereafter, the procedure advances to S109. In S109, it is determined whether the printing job is ended, and if the printing job is ended, the procedure advances to S110, whereas if the printing job is still continuing, the procedure returns to S104. When the printing job returns to S104, if the user has registered the sheet information of the whole job in advance in S113 and S114, it is assumed that sheet information exists, and the procedure automatically advances to S105. Even in a state where the sheet information is treated as "unknown", it is similarly assumed that sheet information exists, and the procedure automatically advances to S105.

This flowchart is one example of the present embodiment, and control can be performed in another form as long as it is possible to predict how many sheets are allowed to pass before performing throughput-down operation using the temperature rise counter based on the sheet information. In other words, another configuration can be adopted as long as image output is performed at a first throughput before the accumulated number of passing sheets from the start of the job, i.e., accumulated number of output sheets of image, exceeds a threshold number of sheets, and image output is performed at a second throughput that is lower (i.e., slower) than the first throughput after the accumulated number exceeds the threshold number of sheets.

For example, in FIG. 4, the accumulated value of the temperature rise counter is calculated for each sheet and compared with the throughput-down threshold, but there may be a case where the job information of the print job for a plurality of sheets is acquired collectively. In that case, it is possible to calculate the accumulated value of the temperature rise counter after forming images to a plurality of sheets in advance when starting the job, and to compare the value with the throughput-down threshold. That is, the engine controller 30 calculates the number of passing sheets according to which the accumulated value of the temperature rise counter exceeds the throughput-down threshold, i.e., threshold number of sheets, when starting a job, and stores the value in a storage portion. After starting the job, the engine controller 30 simply compares the threshold number of sheets stored in the storage portion with the number of passing sheets to the current point of time, and at the point of time when the number of passing sheets exceeds the threshold number of sheets, reduces throughput.

(4-2) Set Value of Temperature Rise Counter

Settings on values of the addition amount per sheet of the temperature rise counter and an initial value of the temperature rise counter according to the present embodiment will be described. Data illustrating correspondence shown below in Tables 1 to 3 is stored in a nonvolatile storage area of the engine controller 30, which can be referred to when the engine controller 30 executes the processing of FIG. 4.

Table 1 shows values of the addition amount per sheet, i.e., numerical values one of which is added per printing of a sheet to the temperature rise counter, with respect to grammage information and surface property information of the recording materials. The values of the addition amount per sheet of the temperature rise counter was set based on the inclination of the graph of FIG. 4. The addition amount per sheet of the temperature rise counter is set greater for a recording material having a greater grammage, such as thick paper, by reflecting the feature shown in FIG. 4 that the degree of increase of the temperature rise of non-sheet passing portion differs according to the grammage and the surface property of the recording material. In other words, a value of the addition amount per sheet for a recording material having a first grammage, such as thick standard paper, is greater than a value of the addition amount per sheet for a recording material having a second grammage smaller than the first grammage, such as plain standard paper. Further, a value of the addition amount per sheet of the temperature rise counter is set greater for a recording material having a smooth surface property, such as coated paper. In other words, in a case where the surface of a first type of a recording material is smoother than the surface of a second type of a recording material, a value of the addition amount per sheet for the first type of the recording material, such as plain smooth paper, is greater than a value of the addition amount per sheet for the second type of the recording material, such as plain standard paper. A value of the addition amount per sheet of the temperature rise counter can be set even in a case where only either one of the grammage information and the surface property information is available. In that case, if the grammage is unknown, the value of the addition amount per sheet of the temperature rise counter for thick paper is set, and if the surface property is unknown, the value of the addition amount per sheet of the temperature rise counter for smooth paper is set so that the temperature rise of non-sheet passing portion does not exceed a target value. If both the grammage and the surface property are unknown, the value of the addition amount per sheet of the temperature rise counter for thick and smooth paper is set.

TABLE 1

| ADDITION AMOUNT PER SHEET OF TEMPERATURE RISE COUNTER | | GRAMMAGE | | |
|---|---|---|---|---|
| | | PLAIN | THICK | UNKNOWN |
| SURFACE PROPERTY | STANDARD | 1.00 | 1.25 | 1.25 |
| | SMOOTH | 1.25 | 1.50 | 1.50 |
| | UNKNOWN | 1.25 | 1.50 | 1.50 |

Table 2 shows weighting factors of the temperature rise counter according to sheet size. All sheets are assumed to be fed and conveyed by long edge feeding. By multiplying a weighting factor for each sheet size to the addition amount per sheet of the temperature rise counter of Table 1, a value of the addition amount per sheet of the temperature rise counter is decided. Normally, if the sheet size, especially the width of the sheet, is small, the weighting factor is set to a greater value since temperature rise of non-sheet passing portion advances quickly. In other words, a value of the addition amount per sheet for a recording material whose width in the direction orthogonal to the sheet conveyance direction is a first length, for example, a B5-size sheet, is greater than a value of the addition amount per sheet of a recording material whose width is a second length greater than the first length, for example, an A4-size sheet. Therefore, in a case where the first length is shorter than the second length, the threshold number of sheets for throughput-down operation of a case where the job is executed using sheets of a recording material whose width in the direction orthogonal to the sheet conveyance direction is a first length, that is, a B5-size sheet, is smaller than the threshold number of sheets of a case where the job is executed using sheets of a recording material whose width is a second length, that is, an A4-size sheet. Meanwhile, in a case where a large-size sheet is passed, the temperature rise of non-sheet passing portion tends to be eased, so that a negative weighting factor is set. For example, a value of the addition amount per sheet of the temperature rise counter of a case where a B5-size sheet of thick smooth paper is passed is $1.5\times2=3.0$, and that of a case where an A3-size sheet of plain standard paper is passed is $1.0\times(-0.5)=-0.5$. The method is not limited to multiplying the weighting factor, and by preparing a table as illustrated in Table 1 for all paper sizes, the addition amount per sheet of small-size sheets can be set greater than the addition amount per sheet of large-size sheets.

TABLE 2

| | | |
|---|---|---|
| WEIGHTING FACTOR OF TEMPERATURE RISE COUNTER FOR EACH SHEET SIZE | A3 | ×−0.5 |
| | A4 | ×1 |
| | B5 | ×2 |
| | COM10 | ×3 |

Table 3 shows an initial value of the temperature rise counter. If elapsed time from previous printing is less than 10 seconds, the printing is assumed to be handled in the same manner as continuous printing, and the history of the temperature rise counter of the previous printing is carried over. Meanwhile, if the elapsed time from the previous printing is 10 seconds or more, the initial value is determined based on the degree of warming of the fixing unit 130. This is because if the fixing unit 130 is warmed up, the temperature rise of non-sheet passing portion reaches the target value with a smaller number of passing sheets. According to the present embodiment, it is determined that the fixing unit 130 is in a hot state if the detection temperature of the thermistor 138 immediately after starting printing operation is 50° C. or higher, and the initial value of the temperature rise counter is set to 5. Further, it is determined that the fixing unit 130 is in a cold state if the detection temperature of the thermistor 138 immediately after starting printing operation is lower than 50° C., and the initial value of the temperature rise counter is set to 0.

TABLE 3

| INITIAL VALUE OF TEMPERATURE RISE COUNTER | | ELAPSED TIME FROM PREVIOUS JOB: 10 SECONDS OR MORE | ELAPSED TIME FROM PREVIOUS JOB: LESS THAN 10 SECONDS |
|---|---|---|---|
| DETECTION TEMPERATURE OF THERMISTOR IMMEDIATELY AFTER STARTING CURRENT JOB | LOWER THAN 50° C. | 0 | CARRY OVER PREVIOUS JOB HISTORY |
| | 50° C. OR HIGHER | 5 | |

The set values of the temperature rise counter illustrated in Tables 1 to 3 should be varied as necessary based on the configuration and performance of the image forming apparatus or the fixing unit. Further, in a case where a plurality of sheets of the same recording material is passed, a value of the addition amount per sheet of the temperature rise counter may be changed according to the number of passing sheets or the difference in sheet passing history.

(5) Advantages of Present Embodiment

The allowable numbers of passing sheets for initial throughput of cases where three types of A4-size recording materials used in FIG. 4 are subjected to continuous sheet passing operation by long edge feeding were compared according to whether throughput-down control according to the present embodiment was performed or not. It is assumed that the detection temperature of the thermistor 138 before starting each printing operation is lower than 50° C. and that the elapsed time from the end of the previous job to the start of the initial sheet passing operation of the current job is 10 seconds or longer.

Figure 5:
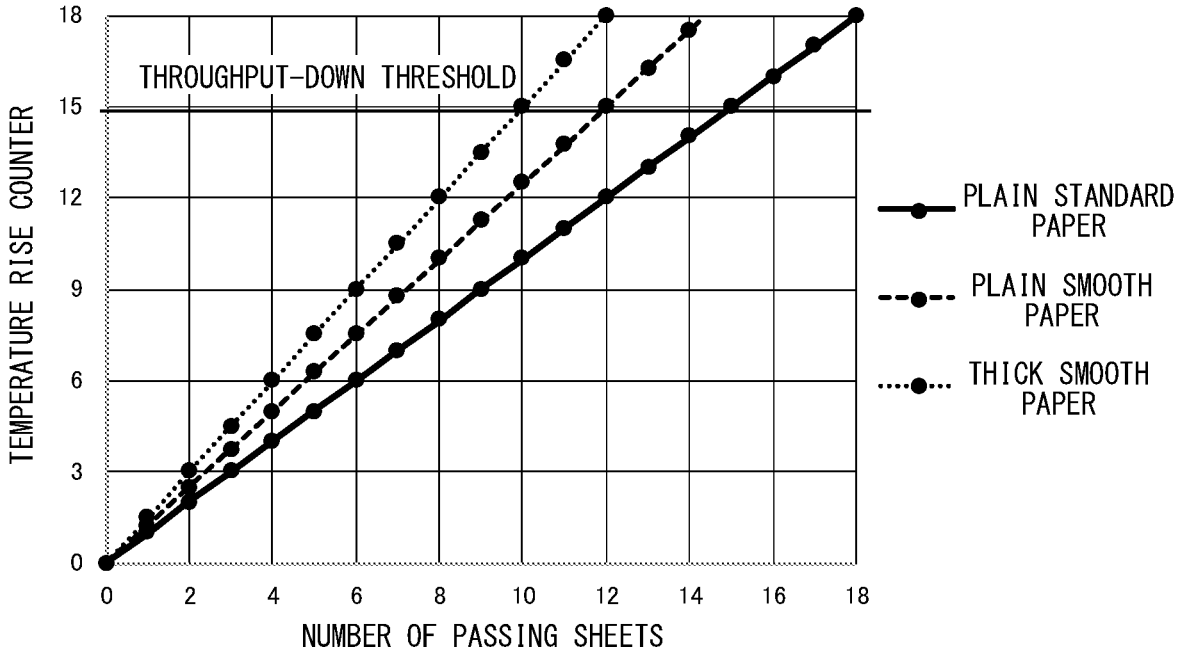
FIG. 5 illustrates a transition example of a temperature rise counter according to the first embodiment.

FIG. 5 illustrates a calculation result of the temperature rise counter per one time of sheet passing. It can be recognized that the rise of the temperature rise counter becomes gentler in the named order from plain standard paper, plain smooth paper to thick smooth paper. The throughput-down threshold is set to 15, so that the allowable number of passing sheets for initial throughput, i.e., threshold number of sheets, is 15 for plain standard paper, 12 for plain smooth paper, and 10 for thick smooth paper. In other words, a value of the threshold number of sheets for executing a job using a recording material having a first grammage, such as thick smooth paper, is smaller than a value of the threshold number of sheets for executing a job using a recording material having a second grammage smaller than the first grammage, such as plain smooth paper. Further, in a case where the surface of a first type of a recording material is smoother than the surface of a second type of a recording material, a value of the threshold number of sheets for executing the job using the first type of the recording material, such as plain smooth paper, is smaller than the threshold number of sheets for executing a job using the second type of the recording material, such as plain standard paper.

These results being compared with a reference example are shown in Table 4. A reference example is a case where control is performed using the image forming apparatus 100 without discriminating the types of recording materials. In the reference example, as described earlier, the allowable number of passing sheets for initial throughput should be set to 10, which corresponds to the case for thick smooth paper according to the present embodiment, so as not to exceed the target value of the temperature rise of non-sheet passing portion. Based on Table 4, the allowable number of passing sheets for initial throughput are increased for plain standard paper and plain smooth paper, which shows that the present embodiment has superiority over the reference example.

TABLE 4

| COMPARISON RESULT | | ALLOWABLE NUMBER OF PASSING SHEETS FOR INITIAL THROUGHPUT: REFERENCE EXAMPLE | ALLOWABLE NUMBER OF PASSING SHEETS FOR INITIAL THROUGHPUT: FIRST EMBODIMENT |
|---|---|---|---|
| SHEET TYPE | PLAIN STANDARD PAPER | 10 | 15 |
| | PLAIN SMOOTH PAPER | 10 | 12 |
| | THICK SMOOTH PAPER | 10 | 10 |

By performing throughput-down control according to the present embodiment as described above, an optimized throughput according to attribute information such as the grammage or the surface property of the recording materials can be realized, and the productivity of the printing operation can be improved.

In the present embodiment, an example has been illustrated where grammage information and surface property information are used as the sheet information of the recording materials, but throughput-down control can also be performed by setting a temperature rise counter using other sheet information. For example, air permeability information or stiffness information of the recording materials can be used. Since the air permeability and the stiffness of a sheet of a recording material indirectly represent the density of the recording material, they may affect the thermal capacity of the sheet of the recording material or the thermal conductivity between the sheet of the recording material and the heating member, according to which the temperature rise of non-sheet passing portion may differ.

Further, the present embodiment has illustrated an example where throughput-down operation is performed in accordance with the temperature rise counter from the initial throughput, but it is also possible to set the initial throughput to a low value and to perform a control to increase the throughput in accordance with the temperature rise counter. Further, only one type of throughput is applied after changing the throughput in the present embodiment, but it is also possible to prepare a plurality of throughput values and to select the throughput in accordance with the temperature rise counter. Further change of throughput can be performed in accordance with the temperature rise counter for the throughput having been changed. Further, by adopting a scheme for reducing the temperature rise counter in accordance with a length of the interval between sheets, for example, a throughput recovery control can be performed where the throughput is returned to the initial throughput if the accumulated value of the temperature rise counter becomes equal to a predetermined value or less.

Second Embodiment

According to the first embodiment, the temperature rise counter was set based on the sheet information entered by the user, and throughput-down control was performed in a case where the temperature rise counter has exceeded a predetermined threshold value. However, in a case where alternate feeding is performed where different types of recording materials are passed alternately, for example, the workability of the user may be deteriorated in a case where printing is performed using multiple types of recording materials, since the user must designate the sheet information for each passing sheet in S113 of FIG. 4. Further, if the user does not designate the sheet information, the accuracy of the temperature rise counter is deteriorated, and the advantage of improvement of productivity may not be achieved. Therefore, according to the second embodiment, a media sensor capable of measuring grammage information and surface property information of the recording materials is used. By arranging the media sensor in the sheet conveyance path within the image forming apparatus and automatically measuring the grammage information and the surface property information of the recording material being actually passed, the user work time can be shortened and accuracy of the temperature rise counter can be improved.

The basic configuration of the image forming apparatus 100A and the fixing unit 130 according to the present embodiment is similar to that of the first embodiment. In the following description, elements denoted with the same reference numbers as the first embodiment are assumed to have approximately similar configurations and actions as the first embodiment, and descriptions thereof are omitted.

(1) Image Forming Apparatus

Figure 6:
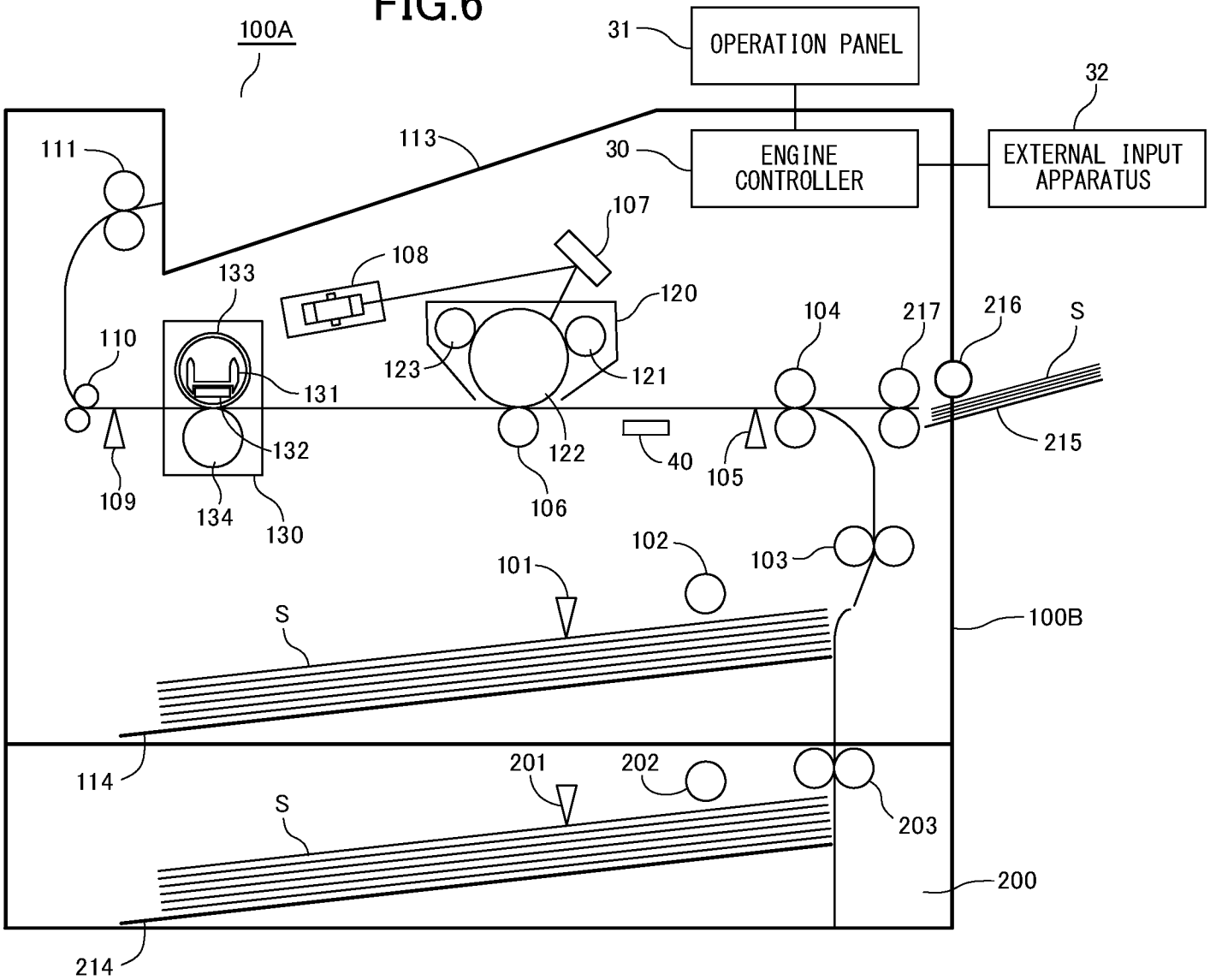
FIG. 6 is a schematic drawing of an image forming apparatus according to a second embodiment.

FIG. 6 is a cross-sectional view illustrating a general configuration of an image forming apparatus 100A according to the present embodiment. With reference to FIG. 6, an additional configuration of the image forming apparatus according to the first embodiment will be described.

As illustrated in FIG. 6, a media sensor 40 for acquiring sheet information of the recording material being used is provided on a sheet conveyance path in the image forming apparatus 100A. Further, an optional sheet feed unit 200 and a multi-purpose tray 215 are additionally provided below a main body portion 100B of the image forming apparatus 100A, which corresponds to the image forming apparatus according to the first embodiment.

The feeding of a sheet of a recording material from the optional sheet feed unit 200 or the multi-purpose tray 215 is performed as follows. If presence of a sheet in a sheet feed cassette 214 is detected by a sheet presence sensor 201, one sheet S is fed from the sheet feed cassette 214 to a feed roller 202, and then sent via a conveyance roller 203 to the conveyance roller 103 of the main body portion 100B. Further, one sheet S is fed from the multi-purpose tray 215 via a feed roller 216 and conveyed via a conveyance roller 217 to the registration roller 104. The subsequent processes are the same as the case where the sheet is fed from the sheet feeding cassette 114.

The media sensor 40 is provided between the registration roller 104 and the transfer roller 106. Therefore, the media sensor 40 can measure the physical property of a sheet of a recording material to acquire sheet information for the sheet S fed from any one of the sheet feeding cassette 114, the sheet feed cassette 214 and the multi-purpose tray 215. The media sensor 40 according to the present embodiment is designed to detect the surface property information and the grammage information of the recording material.

(2) Media Sensor

Figure 7:
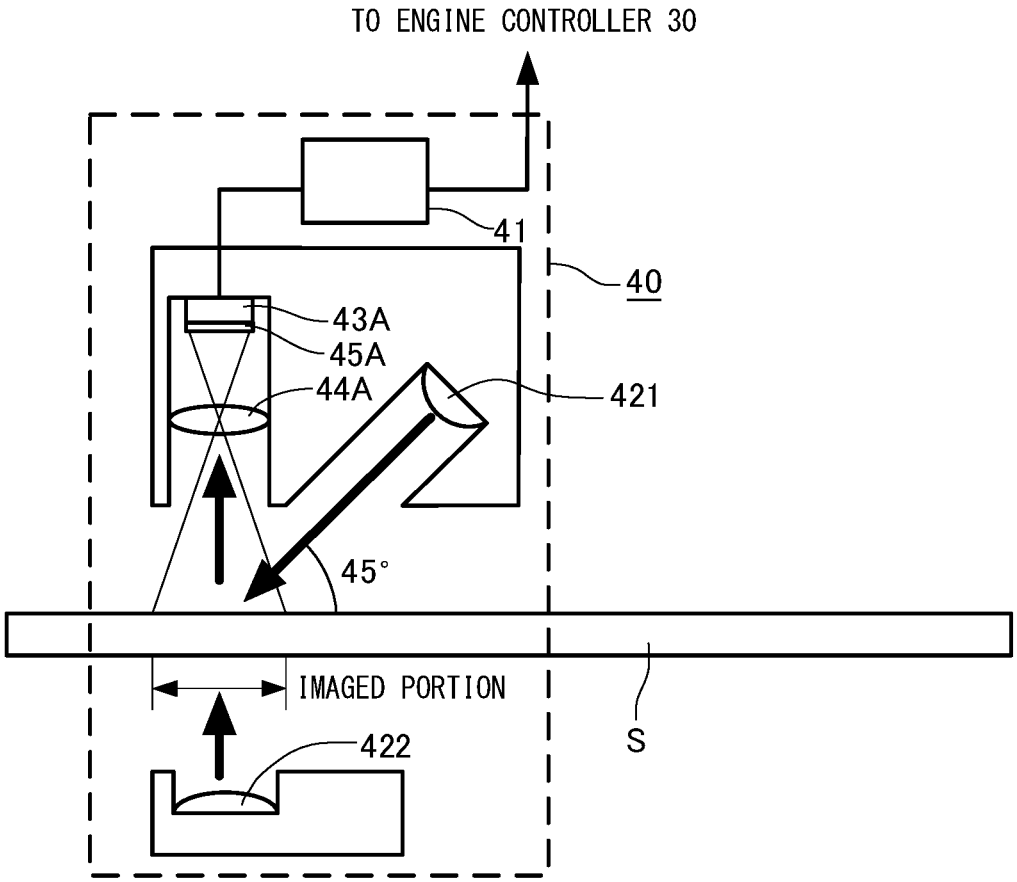
FIG. 7 is a cross-sectional view illustrating a general configuration of a media sensor according to the second embodiment.

FIG. 7 is a schematic cross-sectional view illustrating a general configuration of the media sensor 40. A method for acquiring the sheet information of the media sensor 40 is illustrated with reference to FIG. 7.

The present media sensor 40 includes an LED 421 serving as a first light emitting portion, an LED 422 serving as a second light emitting portion, a CMOS area sensor 43A serving as an imaging portion, and an image focusing lens 44A serving as an image focusing portion. Further, it includes a filtering portion 45A configuring a filtering unit and a drive-calculation unit 41.

The light generated from the LED 421 is a blue light having a maximum wavelength of around 460 nm, and it is emitted toward the surface of the sheet S of the recording material being measured. The blue LED 421 is arranged to emit light with an angle of 45 degrees to the paper surface, and creates a reflected light having a shade corresponding to the unevenness on the surface of the sheet S. The reflected light is condensed via the image focusing lens 44A, and the wavelength component of the reflected light having been transmitted through the filtering portion 45A is formed as reflected light image on the CMOS area sensor 43A. The CMOS area sensor 43A outputs an image voltage signal as an electric signal that changes in accordance with the reflected light amount per area on which image is formed. When the drive-calculation unit 41 receives the image voltage output signal that has been output from the CMOS area sensor 43A, it performs AD conversion thereof, and outputs a digital signal of 256 tones after conversion to the engine controller 30. The digital signal is an example of information related to the surface property of the recording material, that is, information related to surface unevenness.

Meanwhile, the light generated from the LED 422 is a red light having a maximum wavelength of around 640 nm, and it is emitted toward a surface opposite to the surface to which light from the LED 421 is emitted. The red LED 422 is arranged to emit light from a normal direction of the paper surface, and light is transmitted with an attenuation according to the thickness or the grammage of the recording material. The transmitted light is also condensed via the image focusing lens 44A, and the wavelength component transmitted through the filtering portion 45A is formed as a transmitted light image on the CMOS area sensor 43A, where image voltage signal as an electric signal that varies according to the transmitted light amount is output. Based on a similar operation, the drive-calculation unit 41 converts the image voltage signal into a digital signal of 256 tones, and outputs the same to the engine controller 30. The digital signal is one example of the information related to level of grammage, i.e., thickness information, of the recording material.

The media sensor 40 outputs the result having discriminated the information related to surface property and the information related to grammage of the recording material to the engine controller 30.

As described above, the media sensor 40 serving as an acquisition unit according to the present embodiment takes an image of the reflected light and the transmitted light by the CMOS sensor to detect the information related to surface property and the information related to grammage of the recording material. However, the acquisition unit that can be applied to the present embodiment is not limited to this example, and for example, the acquisition unit can be designed to detect the sheet information using the media sensor alone described below or using the plurality of media sensors in combination.

For example, a configuration can be adopted where the surface condition and thickness of the sheet of the recording material is recognized by emitting ultrasonic waves to the sheet of the recording material and detecting the reflectance or transmittance thereof. Alternatively, a signal regarding the unevenness of the surface of the sheet of the recording material or the thickness thereof can be detected using a contact-type piezoelectric device. A similar method is also applicable to other systems, such as a system in which the thickness of the sheet of the recording material is measured using a mechanical sensor, a system in which the surface property of the sheet of the recording material is detected using a contact-type or noncontact-type displacement sensor, or a system using a magnetic-type sheet thickness sensor.

Further, the media sensor is arranged between the registration roller and the transfer roller according to the present embodiment, but the position of the media sensor is not limited thereto. The position in which the media sensor is arranged can be changed in accordance with the type or performance of the media sensor being used.

(3) Throughput-Down Control Method

Now, a method for controlling throughput-down operation will be described using the media sensor 40.

(3-1) Flowchart of Throughput-Down Control

A flowchart of throughput-down control according to the present embodiment is illustrated in FIG. 8. The contents of processing from the start of a print job to setting an initial value of a temperature rise counter as illustrated in S201 to S203 are the same as S101 to S103 of FIG. 4 according to the first embodiment. The process of S211 in a case where a small-size sheet is not included in the print job in S202 is also the same as S111 of FIG. 4.

In S204, a sheet of a recording material is conveyed to a reading position of the media sensor 40, where grammage information and surface property information of the recording material are automatically acquired by the media sensor 40. Thereafter, the procedure advances to S205. In S205, the sheet information in the print job is applied to a temperature rise counter setting table shown in Table 5 described later and Table 2 similar to the first embodiment, and the addition amount per sheet of the temperature rise counter for the number of passing sheets is determined. Thereafter, the contents of processing from S206 to S210 are the same as S106 to S110 of FIG. 4 according to the first embodiment. Note that if the print job is not ended in S209, the procedure advances to S204, where the sheet information of the recording material being printed subsequently is acquired automatically by the media sensor 40.

By adopting the throughput-down control according to the present embodiment, the process of the user to enter sheet information described in S104, S113 and S114 of FIG. 4 can be omitted, so that the work time of the user can be shortened.

(3-2) Set Value of Temperature Rise Counter

An addition amount per sheet of the temperature rise counter according to the present embodiment will be described. A weighting factor of the temperature rise counter according to sheet size is the same as Table 2 of the first embodiment, and initial value of the temperature rise counter is the same as Table 3 of the first embodiment. The data illustrating the correspondence of Table 5 illustrated below is stored in a nonvolatile storage area of the engine controller 30, which can be referred to when the engine controller 30 executes the processing of FIG. 8.

Table 5 is a set value of the addition amount per sheet of the temperature rise counter regarding the grammage and surface property information of the recording material detected by the media sensor 40. By recording the detection results of recording materials having different grammages and surface properties using the media sensor 40 in advance and setting a threshold for the detection signals of grammage and surface property information, thick paper and smooth paper can be discriminated. According to the present embodiment, a case where the sheet information is unknown can be omitted, so that a temperature rise counter having a higher accuracy can be set.

TABLE 5

| ADDITION AMOUNT PER SHEET OF TEMPERATURE RISE COUNTER | | DETECTION RESULT OF GRAMMAGE | |
|---|---|---|---|
| | | PLAIN | THICK PAPER |
| DETECTION RESULT OF SURFACE PROPERTY | STANDARD | 1.00 | 1.25 |
| | SMOOTH | 1.25 | 1.50 |

(4) Advantages of the Present Embodiment

The allowable number of passing sheets for initial throughput in a case where alternate continuous sheet passing operation is performed via long edge feeding of three types of A4-size recording materials illustrated in FIG. 4 were compared for the reference example, the first embodiment and the second embodiment. The first embodiment refers to a case where the user did not select the sheet information. When sheets of multiple types of recording materials are passed, such as when alternately passing sheets of multiple types of recording materials, i.e., alternate passing of sheets, the user may not select the sheet information since the operation for designating the sheet information is complicated.

Figure 9:
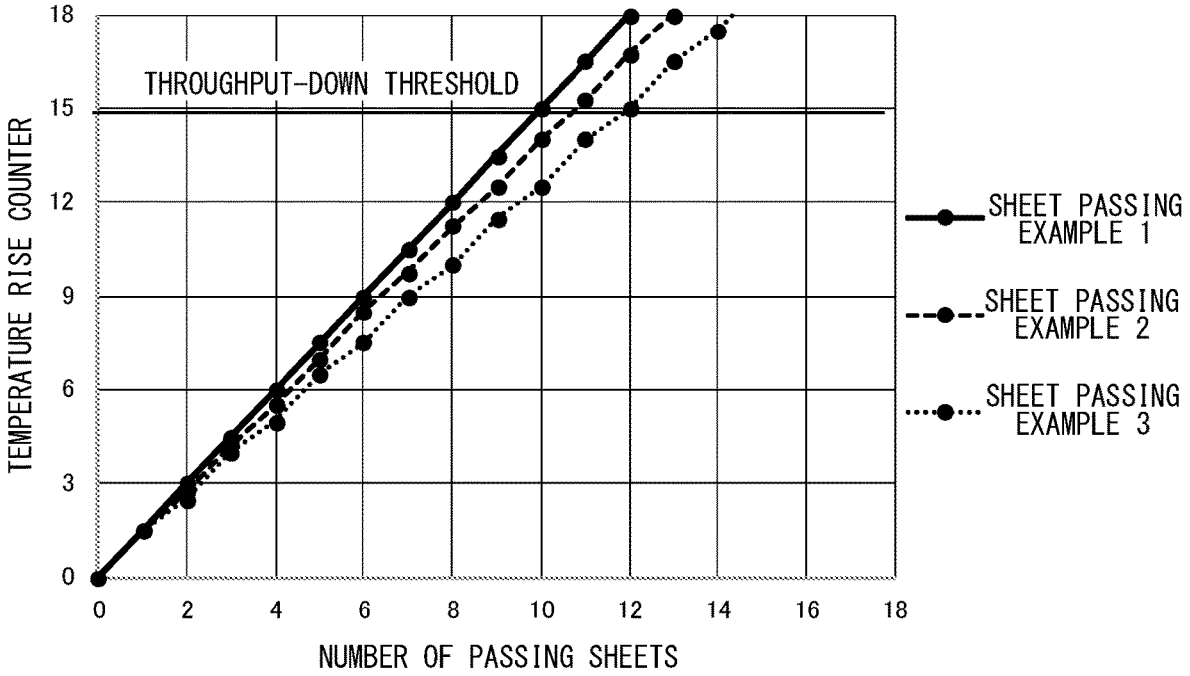
FIG. 9 is a transition example of a temperature rise counter according to the second embodiment.

FIG. 9 illustrates a calculation result of the temperature rise counter for each number of passing sheets in a case where alternate continuous sheet passing operation is performed according to the second embodiment. It is assumed that the detection temperature of the thermistor 138 before starting each printing operation is lower than 50° C., and that the interval between sheets from the previous job is 10 seconds or longer. In sheet passing examples 1 to 3, thick smooth paper is set in the multi-purpose tray 215, plain smooth paper is set in the sheet feeding cassette 114, and plain standard paper is set in the sheet feed cassette 214. Sheet passing example 1 illustrates a case where only thick smooth paper is passed, sheet passing example 2 illustrates a case where thick smooth paper and plain smooth paper are alternately passed, and sheet passing example 3 illustrates a case where a thick smooth paper and a plain standard paper are alternately passed. In any of the sheet passing examples, it is assumed that the first sheet being passed is thick smooth paper.

As illustrated in FIG. 9, in sheet passing example 1, the accumulated value of the temperature rise counter reaches 15, which is the throughput-down threshold, when the number of passing sheets is 10. In sheet passing example 2, the inclination of the temperature rise counter is somewhat gentle compared to sheet passing example 1, and the accumulated value of the temperature rise counter reaches 15 when the number of passing sheets is 11. In sheet passing example 3, the inclination of the temperature rise counter is even more gentle, and the accumulated value of the temperature rise counter reaches 15 when the number of passing sheets is 12.

Table 6 shows these results compared with the reference example and the first embodiment. Reference example is a case where control is performed in which the types of the recording materials are not discriminated, similar to the reference example of the first embodiment, and as mentioned earlier, the allowable number of passing sheets for initial throughput is set to 10 regardless of the type of the recording material, so as not to exceed the target value of the temperature rise of non-sheet passing portion. The first embodiment refers to a case where the user does not select the sheet information, and as shown in Table 1, the addition amount per sheet of the temperature rise counter for thick smooth paper is selected. Therefore, the allowable number of passing sheets for initial throughput is the same for sheet passing examples 1 to 3, and is set to 10 corresponding to thick smooth paper.

In contrast thereto, it can be recognized that according to the present embodiment, in sheet passing examples 2 and 3 where sheets are alternately passed, the temperature rise counter reaches 15, which is the threshold value, on the 11th or 12th sheet of the number of passing sheets. In other words, based on Table 6, it can be recognized that the allowable number of passing sheets for initial throughput has been increased according to the second embodiment than the reference example and the first embodiment when sheets of multiple types of recording materials are passed alternately in one job. Even if the user does not enter the sheet information, according to the second embodiment, the sheet information is acquired automatically using the media sensor 40, and the optimal addition amount per sheet of the temperature rise counter is integrated according to the sheet information.

TABLE 6

| | ALLOWABLE NUMBER OF PASSING SHEETS FOR INITIAL THROUGHPUT | | |
|---|---|---|---|
| COMPARISON RESULT | REFERENCE EXAMPLE | FIRST EMBODIMENT (WHEN PAPER INFORMATION IS UNKNOWN) | SECOND EMBODIMENT |
| SHEET PASSING EXAMPLE 1 | 10 | 10 | 10 |
| SHEET PASSING EXAMPLE 2 | 10 | 10 | 11 |
| SHEET PASSING EXAMPLE 3 | 10 | 10 | 12 |

As described above, in a case where the sheet information is unknown, the accuracy of the temperature rise counter may be improved according to the second embodiment than the first embodiment to thereby further enhance the productivity of the printing operation.

Other Embodiments

A fixing unit including a film-shaped heating member has been described according to the embodiments illustrated above, but for example, a fixing roller having an elastic layer formed on a metallic tube having rigidity can also be used as the heating member. The heating system can adopt a halogen lamp or an induction heating mechanism instead of the ceramic heater.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-011449, filed on Jan. 28, 2020, which is hereby incorporated by reference herein in its entirety.

What is claimed is:

1. An image forming apparatus comprising:

a sheet feeding cassette configured to accommodate sheets of a recording material;

a sheet presence/absence sensor configured to detect presence/absence of the sheet in the sheet feeding cassette;

a top sensor configured to detect a leading edge of the sheet;

an image forming unit configured to form an image on the sheet;

a fixing unit configured to fix the image formed by the image forming unit to the sheet;

a media sensor provided at an upstream side in a sheet conveyance direction from the image forming unit in a sheet conveyance path and configured to measure a surface property and a grammage of the recording material, the media sensor being different from the sheet presence/absence sensor and the top sensor;

a temperature rise counter configured to count a value related to a temperature rising state of an area of the fixing unit where the sheet does not pass, the temperature rise counter being configured to add a count value to the value every time the sheet is measured by the media sensor; and a control unit configured to control the image forming unit and the fixing unit, wherein in a case where the control unit executes a job to form images continuously on a plurality of sheets of the recording material having a width in a direction orthogonal to the sheet conveyance direction smaller than a maximum width of the recording material usable for the image forming apparatus, (i) the count value is determined for each sheet of the plurality of sheets in accordance with the surface property and the grammage of each sheet measured by the media sensor, and (ii) when the value reaches a threshold number by adding the count value for one sheet among the plurality of sheets, the control unit changes a throughput from a first throughput to a second throughput slower than the first throughput and applies the second throughput to the one sheet and subsequent sheets in the job.

2. The image forming apparatus according to claim 1, wherein the count value in a case where the job is executed using a first type of a recording material is larger than the count value in a case where the job is executed using a second type of a recording material, wherein a surface of the first type of the recording material is smoother than a surface of the second type of the recording material.

3. The image forming apparatus according to claim 2, wherein the count value in a case where the job is executed using a recording material having a width, in the direction orthogonal to the sheet conveyance direction, of a first length is larger than the count value in a case where the job is executed using a recording material having a width, in the direction orthogonal to the sheet conveyance direction, of a second length greater than the first length.

4. The image forming apparatus according to claim 1, wherein the fixing unit includes a tubular film, a heater provided in an inner space of the film, a roller forms a fixing nip portion where the sheets passing through in cooperation with the heater through the film, and a temperature detecting element provided in a vicinity of a sheet conveyance reference in the direction orthogonal to the sheet conveyance direction, and wherein the control unit is configured to control an electrical power supplied to the heater so that a temperature detected by the temperature detecting element is maintained at a target temperature during a fixing process of the image formed on the sheet.

* * * * *